US008459085B2

(12) United States Patent
Muschalik et al.

(10) Patent No.: US 8,459,085 B2
(45) Date of Patent: Jun. 11, 2013

(54) METHOD OF AND APPARATUS FOR MAKING PIPE FROM A TUBULAR WORKPIECE

(75) Inventors: Uwe Muschalik, Duisburg (DE); Klaus Steingiesser, Erkelenz (DE)

(73) Assignee: SMS Meer GmbH, Moenchengladbach (DE)

( * ) Notice: Subject to any disclaimer, the term of this patent is extended or adjusted under 35 U.S.C. 154(b) by 447 days.

(21) Appl. No.: 12/697,358

(22) Filed: Feb. 1, 2010

(65) Prior Publication Data

US 2010/0199740 A1 Aug. 12, 2010

(30) Foreign Application Priority Data

Feb. 11, 2009 (DE) ..... 10 2009 008 396
Nov. 9, 2009 (DE) ..... 10 2009 052 482

(51) Int. Cl.
*B21D 22/00* (2006.01)

(52) U.S. Cl.
USPC ..... 72/361; 72/420

(58) Field of Classification Search
USPC ..... 72/76, 293, 295, 296, 361, 370.01, 72/420, 421
See application file for complete search history.

(56) References Cited

U.S. PATENT DOCUMENTS

| | | | | | |
|---|---|---|---|---|---|
| 3,281,170 | A * | 10/1966 | Kaplan | 403/373 |
| 3,753,365 | A * | 8/1973 | Kralowetz | 72/76 |
| 3,893,321 | A * | 7/1975 | Braunwieser | 72/76 |
| 3,921,665 | A * | 11/1975 | Lebzelter | 137/553 |
| 4,211,310 | A * | 7/1980 | Lupertz | 188/73.43 |
| 4,592,616 | A * | 6/1986 | Drew et al. | 439/578 |
| 4,877,356 | A * | 10/1989 | Bontenbal | 405/169 |
| 5,163,706 | A * | 11/1992 | Maguran et al. | 188/283 |
| 5,218,855 | A | 6/1993 | Werner | 72/420 |
| 5,986,449 | A * | 11/1999 | Koski | 324/207.13 |
| 6,428,017 | B1 * | 8/2002 | Galonska et al. | 277/616 |
| 7,861,572 | B2 * | 1/2011 | Geser | 72/370.13 |
| 8,006,532 | B2 * | 8/2011 | Trabattoni | 72/344 |
| 2005/0243434 | A1 | 11/2005 | Endo | |
| 2006/0045399 | A1 * | 3/2006 | Essam et al. | 384/208 |

* cited by examiner

*Primary Examiner* — Edward Tolan
*Assistant Examiner* — Homer Boyer
(74) *Attorney, Agent, or Firm* — Andrew Wilford

(57) ABSTRACT

A tubular workpiece with a throughgoing bore is held by a handler having a passage alignable with the bore and of a predetermined inside passage diameter. A rod carrying a mandrel and of an outside rod diameter is provided with a guide having an outside guide diameter slightly smaller than the inside passage diameter but greater than the outside rod diameter The passage is aligned by the handler with the workpiece bore and the mandrel is inserted through the handler passage into the workpiece bore while sliding the guide along the passage and centering the rod in the passage with the guide out of contact with an inner surface of the passage. The workpiece is externally engage around the mandrel with forging tools and thereby forged around the mandrel.

5 Claims, 5 Drawing Sheets

METHOD OF AND APPARATUS FOR MAKING PIPE FROM A TUBULAR WORKPIECE

FIELD OF THE INVENTION

The present invention relates to the manufacture of pipe. More particularly this invention concerns pipe made from a tubular workpiece.

BACKGROUND OF THE INVENTION

It is known to forge a long tube, e.g. a piece of pipe, from a prepunched or tubular workpiece. To this end the tubular workpiece is gripped by a handler and brought into the working space of a forging machine. Before the tubular workpiece is forged in the forging machine a mandrel on a rod is inserted axially through a guide passage in the handler and into a bore of the tubular workpiece. Tools of the forging machine plastically deform the metal of the workpiece so it internally conforms to the outside shape of the mandrel, such deformation normally thinning the walls and lengthening the workpiece.

The forging machine has several tools or forging jaws acting radially on the tubular workpiece. The tubular workpiece fed or loaded on the charging side upstream of the forging machine, for example, by pivoting is gripped and held by the workpiece handler, e.g. by grippers, as is known for example from U.S. Pat. No. 5,218,855. In the tubular workpiece thus held by the workpiece handler for forge handling, the rod with the mandrel on its end, which can be acted on axially by a control drive, is moved through a hollow passage of the workpiece handler.

The centered insertion of the mandrel into the tubular workpiece hereby is fairly difficult, especially in view of the great length of the rod, which promotes deflection.

It is known from DE 200 07 682 to guide the rod in a holding fixture provided for the axial support and rotational engagement of the workpiece, which holding fixture is supported in a clamping head housing in a rotationally and axially displaceable manner. The holding fixture has for this purpose a guide sleeve in which a bushing surrounding a guide section of the rod is rotatably fixed. The disadvantage of this solution is that the rod guidance is very complex, which results in corresponding costs.

OBJECTS OF THE INVENTION

It is therefore an object of the present invention to provide an improved pipe-making method and apparatus.

Another object is the provision of such an improved pipe-making method and apparatus that overcomes the above-given disadvantages, in particular that render possible in a simple manner a central insertion of the mandrel into the tubular workpiece and thereby rule out deflection of the rod as far as possible.

SUMMARY OF THE INVENTION

According to the invention the tubular workpiece is held by a handler having a passage alignable with the bore and of a predetermined inside passage diameter. A rod carrying a mandrel and of an outside rod diameter is provided with a guide having an outside guide diameter slightly smaller than the inside passage diameter but greater than the outside rod diameter The passage is aligned by the handler with the workpiece bore and the mandrel is inserted through the handler passage into the workpiece bore while sliding the guide along the passage and centering the rod in the passage with the guide out of contact with an inner surface of the passage. The workpiece is externally engage around the mandrel with forging tools and thereby forged around the mandrel.

The centering guide is thereby preferably held in the forging machine axially outside the tubular workpiece and inside the passage during the entire forging process.

The bore of the tubular workpiece and/or the mandrel are preferably provided with a lubricant or release agent before the insertion of the mandrel into the bore of the tubular workpiece.

The bore of the tubular workpiece and the mandrel are designed with respect to their diameter such that no contact occurs between the mandrel and the bore of the tubular workpiece during the axial insertion of the mandrel into the bore of the tubular workpiece and before the forging process.

The apparatus for producing pipe from a prepunched tubular workpiece comprises a workpiece handler with a passage for gripping and axially displacing the tubular workpiece, a forging machine and a rod with a mandrel arranged thereon for the axial movement through the guide passage in the workpiece handler and for axial insertion into the bore of the tubular workpiece. The apparatus is characterized according to the invention in that the rod has a centering guide whose outside diameter is slightly smaller than or equal to the inside diameter of the passage of the workpiece handler and the outside diameter of the rod is smaller than the outside diameter of the centering guide.

According to a preferred embodiment, the centering guide has at least two parts, concentrical to one another. In particular an inner part has a part-spherical outer surface embodied that engages a complementary surface of outer part. The centering guide can be provided on its outer surface with at least one chamfer.

The centering guide can be axially fixed on the rod on both sides by clamps.

The diameter of the bore of the tubular workpiece is preferably greater before the forge processing thereof than the outside diameter of the mandrel.

In the proposed solution, the rod with the mandrel is centered in the passage of the workpiece handler in an advantageous manner and thus directly at the site of the action and centrally supported therein during the axial control movements of the handler and/or of the rod actuator guided over the entire length of the passage.

To this end, the rod is provided with a centering guide or centering ring, the outside diameter of which corresponds approximately to the inside diameter of the passage of the workpiece handler.

The proposed approach and apparatus are used advantageously in particular with pipe forging. A functional centering of the combination of mandrel and rod occurs inside the workpiece handler.

Deflection of the relatively long rod can be efficiently prevented or in any case substantially minimized by the use of the centering guide. The mandrel can be inserted centrally into the tubular workpiece.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
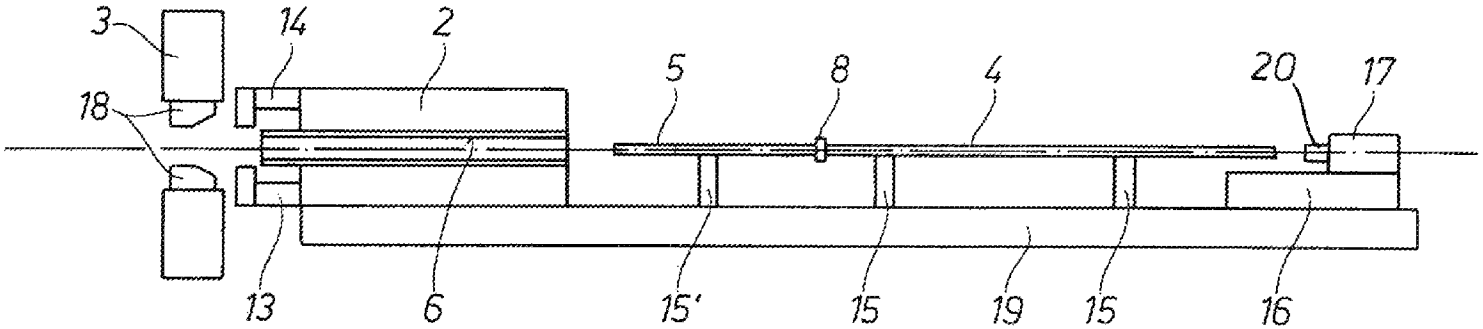
FIG. 1 is a diagrammatic side view of the pipe-making apparatus of this invention at a first step of the production process.
Figure 5:
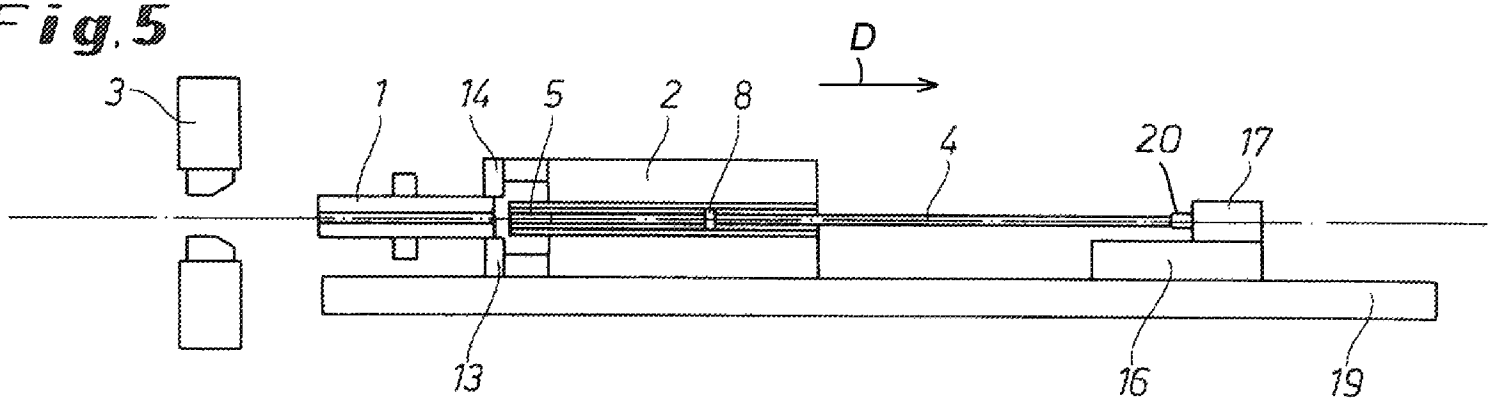
Figure 6:
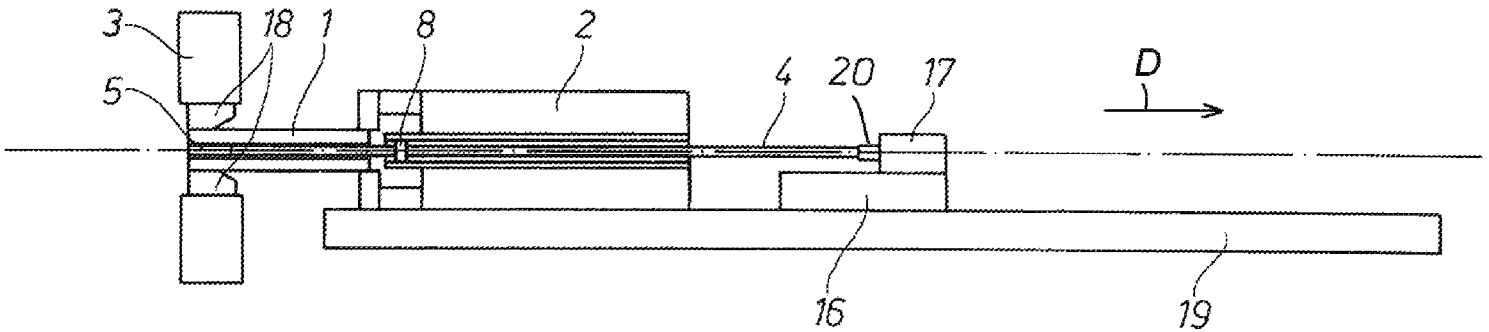

As seen in FIG. 1 a workpiece handler 2 shiftable in a workpiece-travel direction D on a stationary workpiece frame 19 has two or four grippers 13, 14 for holding and clamping a tubular workpiece 1 (see FIGS. 5 and 6). The upstream side of the workpiece handler 2 is turned toward a forging machine 3 in which the tubular workpiece 1 can be forged by means of tools 18 acting on it radially from outside. Forging with the tools 18 does not occur until a mandrel 5 has been inserted into an bore 7 (see FIG. 7) of the tubular workpiece 1. The mandrel 5 is mounted on the upstream end of a rod 4. In a manner known per se the rod 4 together with the mandrel 5 is guided through a guide passage 6 formed by a liner tube in the workpiece handler 2 and into the bore 7 of the tubular workpiece 1 held by the grippers 13 and 14.

For maneuvering the rod 4 it is supported near the workpiece handler 2 on an upstream support 15' and on other supports 15 spaced downstream therefrom in the first step of FIG. 1. Furthermore, a slide 17 movable in and against the workpiece-travel direction on a fixed base 16 at the downstream end of the machine frame 19 carries a drive 17 that can rotate the rod 4 and mandrel 5 about an axis parallel to this direction D. In the FIG. 1 position, the mandrel 5 and the rod 4 rest on the supports 15 and 15', respectively.

Figure 2:
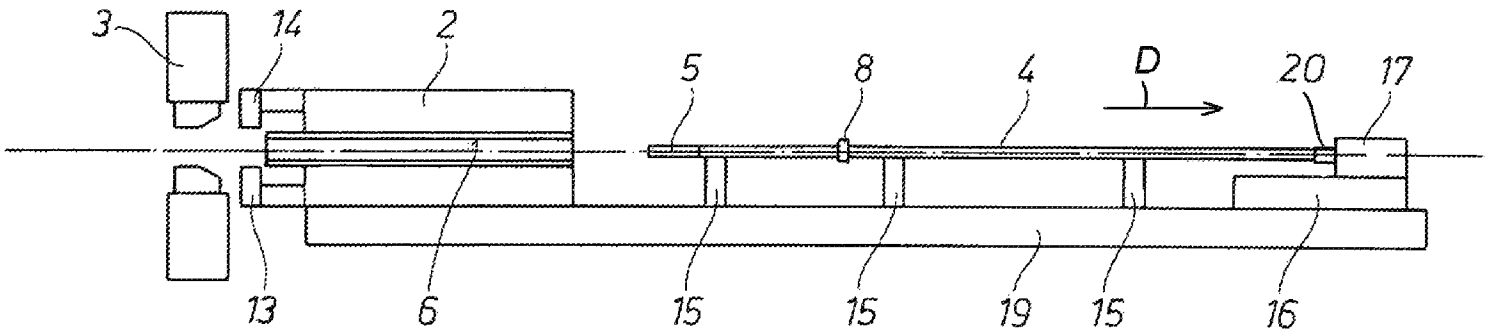
FIGS. 2-6 are views like FIG. 1 of second through sixth steps of the process.

Then as shown in FIG. 2 the rod 4 is shifted downstream in the direction D and fitted in a chuck 20 of the mandrel actuator 17.

Figure 3:
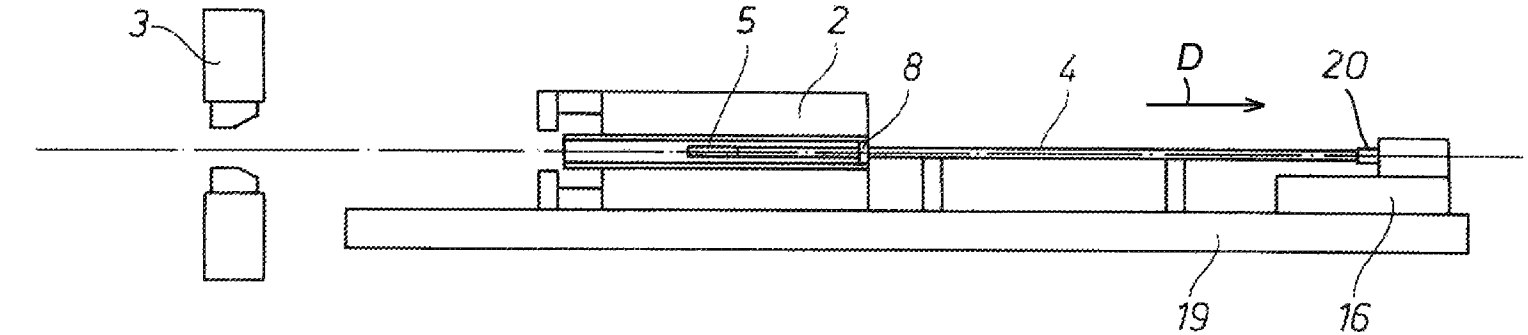

According to FIG. 3, the workpiece handler 2 then moves downstream and inserts the mandrel 5 together with the rod 4 into the downstream end of the passage 6 of the workpiece handler 2. Alternatively or in addition the mandrel base 16 shifts the actuator 17 upstream.

Figure 4:
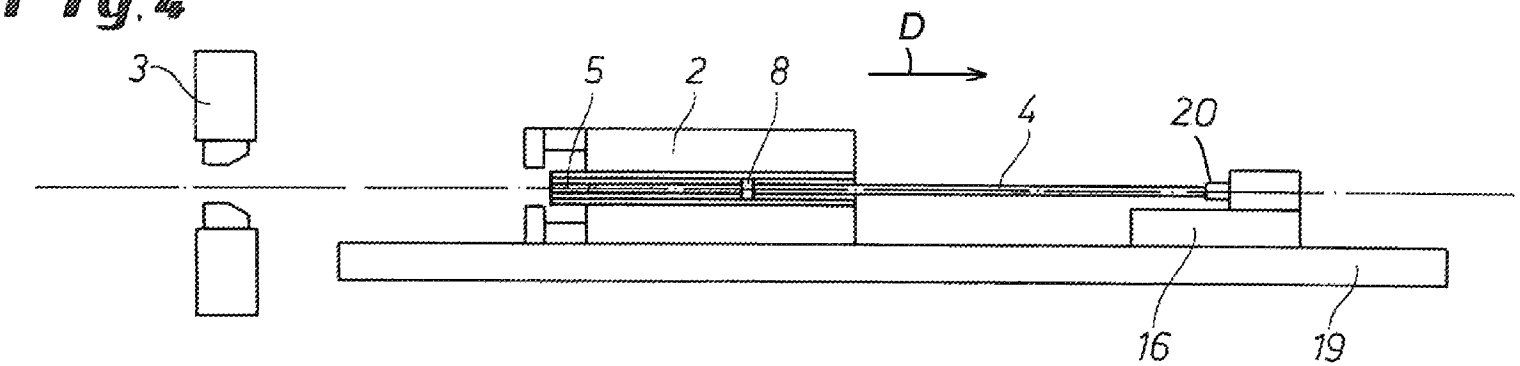

Subsequently, as shown in FIG. 4 the mandrel base 16 shifts upstream to push the mandrel 5 together with the rod 4 all the way through the guide passage 6 of the workpiece handler 2.

According to FIG. 5, the tubular workpiece 1 is pivoted into a position aligned upstream with the passage 6. The tubular workpiece 1 is then grasped and held by the grippers 13 and 14, that is the workpiece handler 2 clamps the tubular workpiece 1 in preparation for forging.

The forging itself is carried out as shown in FIG. 6. The workpiece handler 2 and mandrel actuator 17 move upstream into the forger 3. The mandrel 5 is thus axially fitted into and substantially through the tubular workpiece 1 such that the forging process can be carried out around it by the forging tools 18.

FIGS. 1 through 6 thus show the sequential order of the production of a length of pipe from the tubular workpiece 1 from the placement of the rod 4, preferably on workpiece supports 15 and an additional support 15' carried on the machine base 19 through the inserting of the rod 4 with a centering guide 8 explained below into the passage of the workpiece handler 2, and finally the centered guidance of the rod via its centering guide 8 with axial movement of the handler 2 and/or of the rod drive 17 formed as a slide.

The important factor is that the rod 4 has at least one centering guide 8, here only one. Details in this regard are shown in FIG. 7, in which the most important parts of the apparatus can be seen.

An outside diameter $D_Z$ of the centering guide 8 is slightly smaller than an inside diameter $D_I$ of the passage 6 of the workpiece handler 2; at most, it is of the same size. However, an outside diameter $D_A$ of the rod 4 is smaller than the outside diameter $D_Z$ of the centering guide 8.

As a result, the rod 4 can be guided through the passage 6 of the workpiece handler 2 such that there is contact between the outer surface of the centering guide 8 and the inner surface passage 6 of the workpiece handler 2, but there is no contact between the rod 4 and the passage 6 of the workpiece handler 2.

Figure 7:
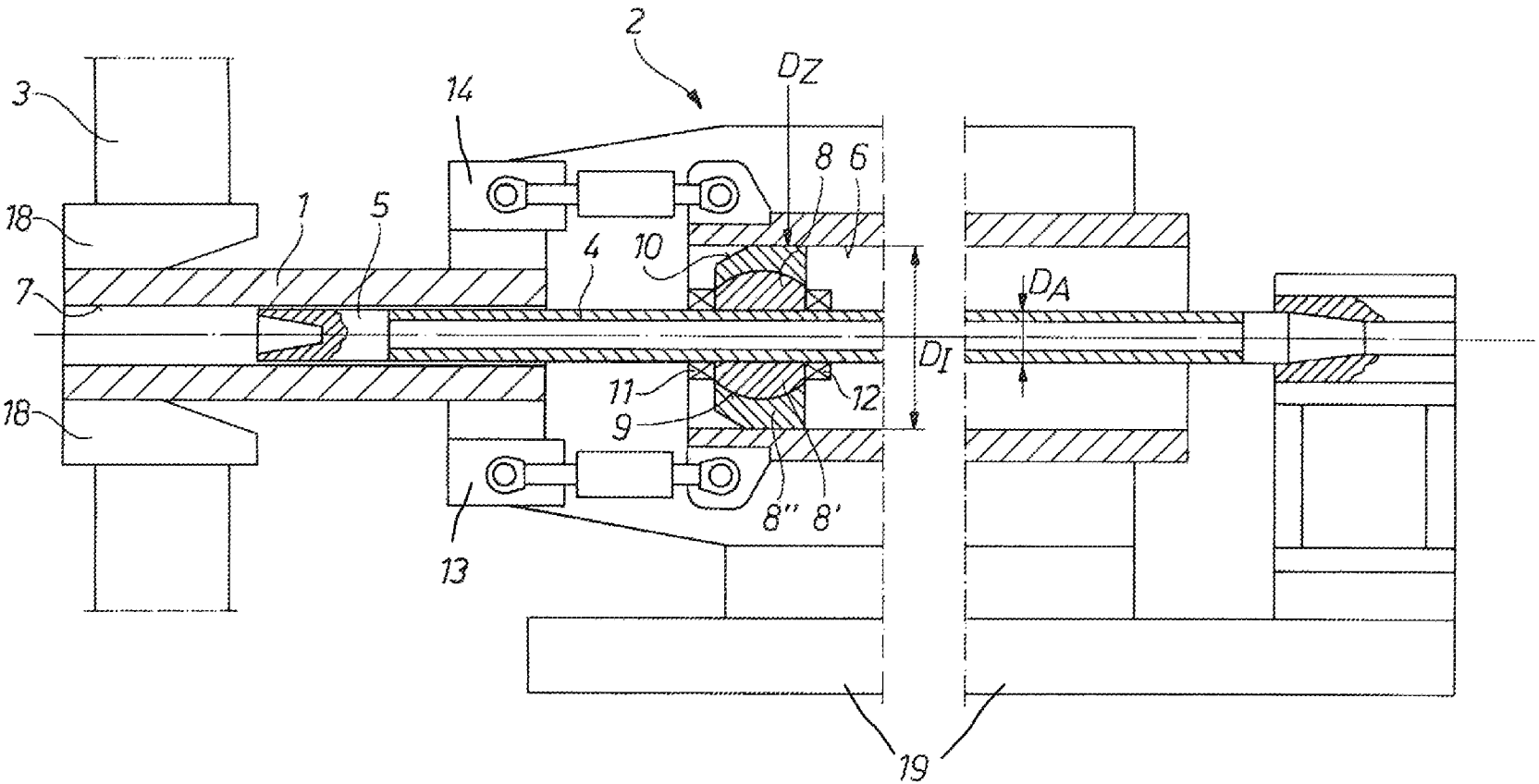
FIG. 7 is a large-scale longitudinal section through the pipe-making apparatus as in FIG. 1.

The structure of the supporting centering guide 8 is very advantageous as shown by FIG. 7. The centering guide 8 is essentially composed of two parts, namely an inner part 8' and a concentric outer part 8". For assembly, the outer part 8" must in turn be formed by two segments so it can be fitted around the inner part 8', but these two segments are fixed together once in place.

The inner part 8' has a part-spherically convex outer surface 9 as shown in the diametral section of FIG. 7. The part 8" is correspondingly part-spherically concave. This dome-like design has the advantage that there is always a centered load in the passage 6 of the workpiece handler 2. The inner part 8' is fixed axially on the rod 4 against movement in or against the direction by clamps 11 and 12. Displacement and in particular inserting of the rod 4 and thus of the centering guide 8 into or out of the passage 6 is facilitated by a chamfer 10 formed at the upstream side of the outer part 8".

During insertion of the mandrel 5 into the bore 7 of the tubular workpiece 1, it is possible due to the precise centering of the mandrel 5 and the mandrel rod 4 to avoid the mandrel 5 ever touching the inner wall of the bore 7. The wall of the bore 7 as a rule is coated or provided with a lubricant or release agent. Accordingly, during insertion of the mandrel 5 into the bore 7 an air gap remains between the mandrel and the bore 7, as indicated in FIG. 7.

Figure 8:
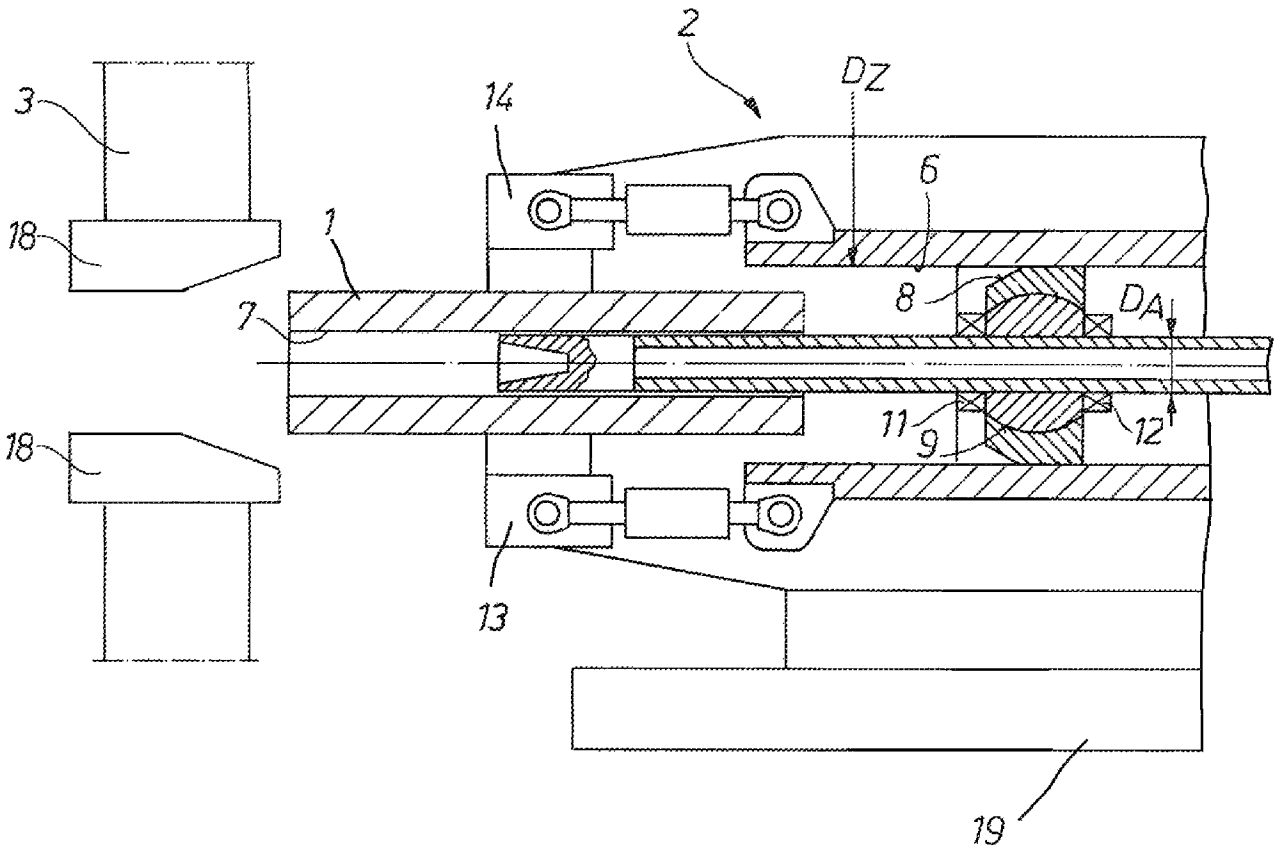
FIG. 8 is a view like FIG. 7 but showing the workpiece retracted partially back into the handler.

Furthermore as indicated in FIG. 8 the workpiece 1 can in fact be pulled back into the passage 6 during and/or after the forging operation without any possibility of it damaging the handler 2.

Deflection of the rod 4 inside the tubular workpiece 1 is therefore considerably reduced by the centering guide 8 on the rod 4

We claim:

1. An apparatus for making pipe from a tubular workpiece having a throughgoing bore, the apparatus comprising:

a handler for holding the tubular workpiece and having a passage alignable with the bore and of a predetermined inside passage diameter;

a rod of an outside rod diameter;

a mandrel carried by the rod;

a guide on the rod formed by an inner part carried on the rod and having a part-spherical outer surface centered on a point and by an outer part fitting over the inner part, having an outside guide diameter equal to or slightly smaller than the inside passage diameter but greater than the outside rod diameter, fitting around the inner part, and having a part-spherical inner surface complementary to and concentric with the outer surface of the inner part for movement of the inner part relative to the outer part about the point;

means for, when the passage is aligned by the handler with the workpiece bore, inserting the mandrel through the handler passage into the workpiece bore while sliding the guide along the passage and centering the rod in the passage by means of the guide; and a forger for externally engaging the workpiece around the mandrel with forging tools and thereby forging the workpiece around the mandrel.

2. The pipe-making apparatus defined in claim 1 wherein the outer part has a substantially cylindrical outer surface complementary to the inner surface of the passage and is formed at an end turned toward the forger with a chamfer.

3. The pipe-making apparatus defined in claim 1 wherein the rod is provided with clamps axially fixing the inner part on the rod.

4. The pipe-making apparatus defined in claim 1 wherein the passage inner surface is cylindrical and the guide has a complementary cylindrical outer surface.

5. The pipe-making apparatus defined in claim 1, further comprising:

means for rotating the mandrel and rod about an axis of the rod.

* * * * *